US007209679B2

(12) United States Patent
Kim et al.

(10) Patent No.: US 7,209,679 B2
(45) Date of Patent: Apr. 24, 2007

(54) METHOD FOR CONTROLLING OXIDATION CATALYST DEVICE OF WET-TYPE ELECTROPHOTOGRAPHIC IMAGE FORMING APPARATUS

(75) Inventors: Hyou-jin Kim, Seoul (KR); Jeong-hun Pang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 221 days.

(21) Appl. No.: 10/861,403

(22) Filed: Jun. 7, 2004

(65) Prior Publication Data

US 2005/0100359 A1 May 12, 2005

(30) Foreign Application Priority Data

Nov. 7, 2003 (KR) ..... 10-2003-0078729

(51) Int. Cl.
*G03G 21/20* (2006.01)

(52) U.S. Cl. ..... 399/92; 399/93

(58) Field of Classification Search ..... 399/91–93
See application file for complete search history.

(56) References Cited

U.S. PATENT DOCUMENTS

2003/0219274 A1* 11/2003 Hirose et al. ..... 399/92

FOREIGN PATENT DOCUMENTS

| | | | |
|---|---|---|---|
| JP | 57104968 | | 6/1982 |
| JP | 02273764 | | 11/1990 |
| JP | 08069228 A | * | 3/1996 |
| JP | 09222832 A | * | 8/1997 |
| JP | 2000242146 | | 9/2000 |
| JP | 2001092304 A | * | 4/2001 |
| KR | 20020062510 | | 7/2002 |

* cited by examiner

*Primary Examiner*—David M. Gray
*Assistant Examiner*—Ryan Gleitz
(74) *Attorney, Agent, or Firm*—Roylance, Abrams, Berdo & Goodman, L.L.P.

(57) ABSTRACT

An oxidation catalyst device for a wet-type electrophotographic image forming apparatus and method of controlling the same are provided. The oxidation catalyst device includes a duct for guiding air inside a fixation device to the outside of the fixation device. The oxidation catalyst device further includes a fan for forcibly discharging the air inside of the fixation device, a heater for heating the air discharged from the fixation device, and an oxidation catalyst device-carrying body for facilitating oxidation resolution reaction of the carrier vapors entrained in the discharged air. The fan is driven at a first rotational speed of $N_1$, during which the oxidation catalyst carrying body is warmed up, and a second rotational speed of $N_2$, during which carrier vapors are heated and resolved.

19 Claims, 7 Drawing Sheets

METHOD FOR CONTROLLING OXIDATION CATALYST DEVICE OF WET-TYPE ELECTROPHOTOGRAPHIC IMAGE FORMING APPARATUS

CROSS-REFERENCE TO RELATED APPLICATIONS

This application claims the benefit under 35 U.S.C. §119 (a) of Korean Application No. 2003-78729, filed Nov. 7, 2003, in the Korean Intellectual Property Office, the disclosure of which is incorporated herein by reference in its entirety.

BACKGROUND OF THE INVENTION

1. Field of the Invention

The present invention relates to a wet-type electrophotographic image forming apparatus. More particularly, the present invention relates to a method for controlling an oxidation catalyst device for a wet-type electrophotographic image forming apparatus for improving the oxidation resolution efficiency of carrier vapors produced when a paper deposited with a developer passes through a fixation device.

2. Description of the Related Art

In general, a wet-type electrophotographic image forming apparatus scans a laser beam on a photosensitive medium to form an electrostatic latent image, deposits a developer on the electrostatic latent image, thereby forming a visible image, and transfers the visible image onto a predetermined paper. Thus, a desired image is printed out. The wet-type electrophotographic image forming apparatus is preferred in color printing because it can produce a more distinct image as compared to a dry-type electrophotographic image forming apparatus that uses powder toner.

FIG. 1 shows a construction of a conventional wet-type electrophotographic image forming apparatus.

As shown in FIG. 1, the conventional wet-type electrophotographic image forming apparatus 100 comprises an image forming apparatus body 110, a plurality of photosensitive drums 121, 122, 123, and 124, a plurality of charging devices 131, 132, 133, and 134 for charging the respective photosensitive drums 121, 122, 123, and 124 to a predetermined potential. Apparatus 100 further comprises a plurality of exposure devices 141, 142, 143, and 144 for scanning a laser beam onto the respective electrified photosensitive drums 121, 122, 123, and 124; a plurality of developing devices 151, 152, 153, and 154 for supplying developers to the respective photosensitive drums 121, 122, 123, and 124 to form a visible image; and a plurality of first transfer rollers 171, 172, 173, and 174 for transferring the visible images formed on the respective photosensitive drums 121, 122, 123, and 124 onto a transfer belt 160. In addition, apparatus 100 comprises a second transfer roller 180 for transferring a resultant image formed on the transfer belt 160 from overlapped visible images to a paper P, and a fixation device 190 for applying heat and pressure to a paper P with the transferred resultant image, thereby fixing the resultant image on the paper P.

The plurality of developing devices 151, 152, 153, and 154 store developers of different colors, respectively, and each of the developing devices supplies a color developer to one of the plurality photosensitive drums 121, 122, 123, and 124. The developers consist of an ink and liquid carrier such as Norpar. Norpar is a hydrocarbon-based solvent, which is a mixture of $C_{10}H_{22}$, $C_{11}H_{24}$, $C_{12}H_{26}$, and $C_{13}H_{28}$. Developers deposited on the respective photosensitive drums 121, 122, 123, and 124 to form visible images are transferred to the transfer belt 160 and are overlapped with each other. A resultant image is formed from the overlapped visible images on the transfer belt 160. The resultant image is then transferred to paper P forming the desired image. The paper P then passes through the fixation device 190, where the ink component in the developers is fixed on the paper and the liquid carrier is vaporized by high temperature and discharged outwardly in the form of a combustible hydrocarbon gas, such as $CH_4$.

The combustible hydrocarbon gas is a volatile organic compound, which can contaminate the environment and emits an offensive odor when discharged.

Methods for removing combustible hydrocarbon gases known in the art include a filtration method for physically removing gaseous components using a carbon filter such as active carbon, a direct combustion method for combusting gaseous components at an ignition point (600° C. to 800° C.), and a catalytic oxidation method for combusting gaseous components at a relatively lower temperature (150° C. to 400° C.) using a catalyst, thereby oxidizing and resolving the components into water and carbon dioxide.

In the filtration method, the carbon filter does not have a capability of resolving the entrained carrier vapors. Therefore, a carbon filter saturated with carrier vapors needs to be replaced frequently when the amount of entrained carrier vapors exceeds a predetermined amount. The direct combustion method is potentially unsafe.

Due to the above described problems, wet-type electrophotographic image forming apparatuses have mainly employed the catalytic oxidation method for removing carrier vapors. In addition, various advancements have been made for increasing the efficiency of oxidizing and resolving carrier vapors.

SUMMARY OF THE INVENTION

An object of the present invention is to overcome the above problems and disadvantages and to provide other advantages described below. Accordingly, an object of the present invention is to provide a method for controlling an oxidation catalyst device for a wet-type electrophotographic image forming apparatus in order to improve the efficiency of oxidizing and resolving carrier vapors generated when a paper deposited with a developer passes a fixation device.

In order to achieve the above-described aspects of the present invention, there is provided a method of controlling an oxidation catalyst device for a wet-type electrophotographic image forming apparatus in which the oxidation catalyst device comprises a duct for guiding air inside of a fixation device that applies heat and pressure to a paper deposited with a developer consisting of ink and liquid carrier to the outside of the fixation device; a fan for forcibly discharging the air inside the fixation device; a heater for heating the air discharged from the fixation device; and an oxidation device-carrying body for facilitating an oxidation resolution reaction of the carrier vapors entrained in the air being discharged. The method comprises a first step of driving the fan at a rotational speed of $N_1$, during which the oxidation catalyst carrying body is warmed up, and a second step of driving the fan at a rotational speed of $N_2$, during which the carrier vapors are heated and resolved.

The fan driving step may further comprise a third step for driving the fan at a rotational speed of $N_3$, during which the fixation device is cooled.

In a preferred embodiment of the present invention, the rotational speeds, $N_1$, $N_2$ and $N_3$ in the first to third steps have a relation of $N_3>N_1>N_2$.

BRIEF DESCRIPTION OF THE PREFFERED EMBODIMENTS

The above objects and other features of the present invention will become more apparent by describing in detail a preferred embodiment thereof with reference to the attached drawings, wherein.

Figure 5A:
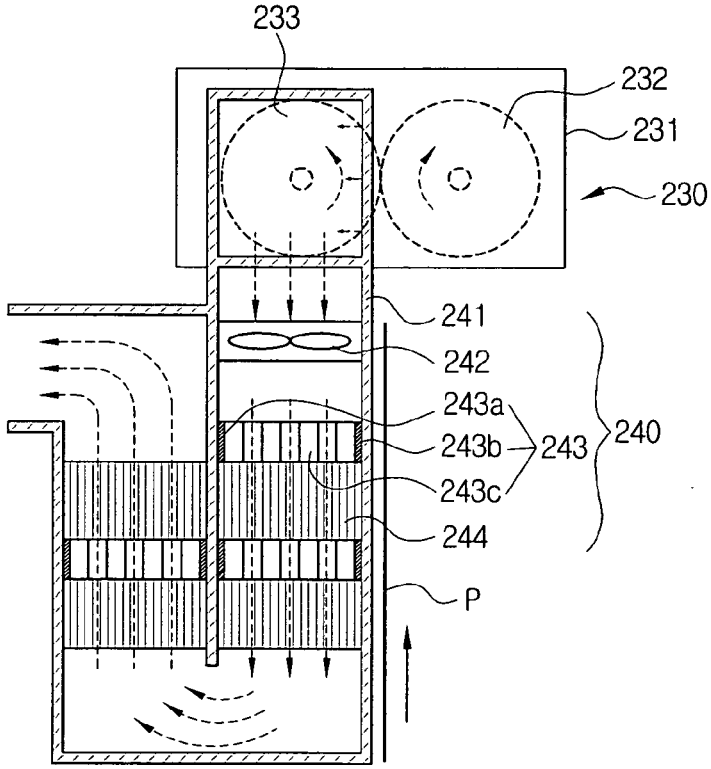
Figure 5B:
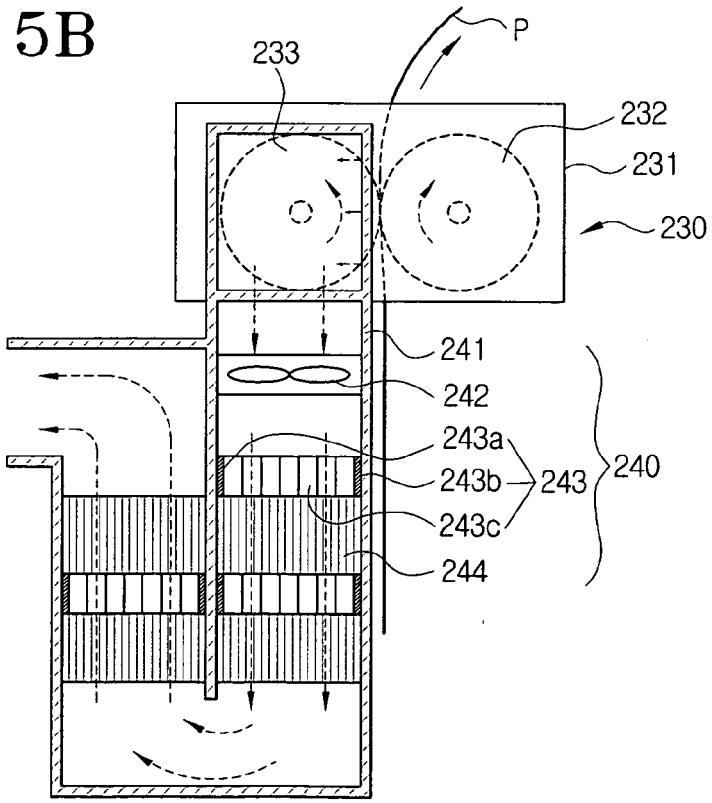
Figure 5C:
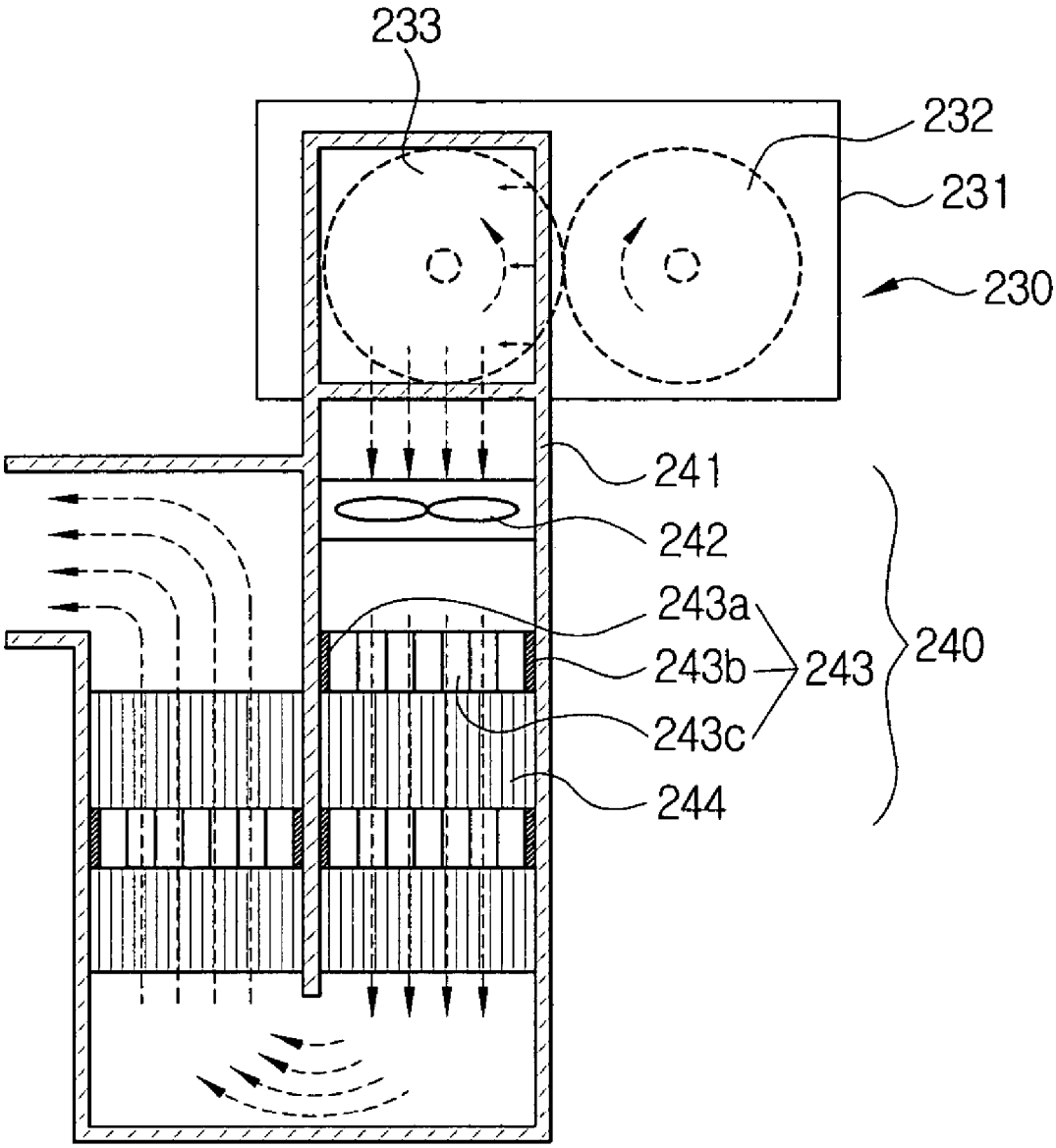
Figure 6:
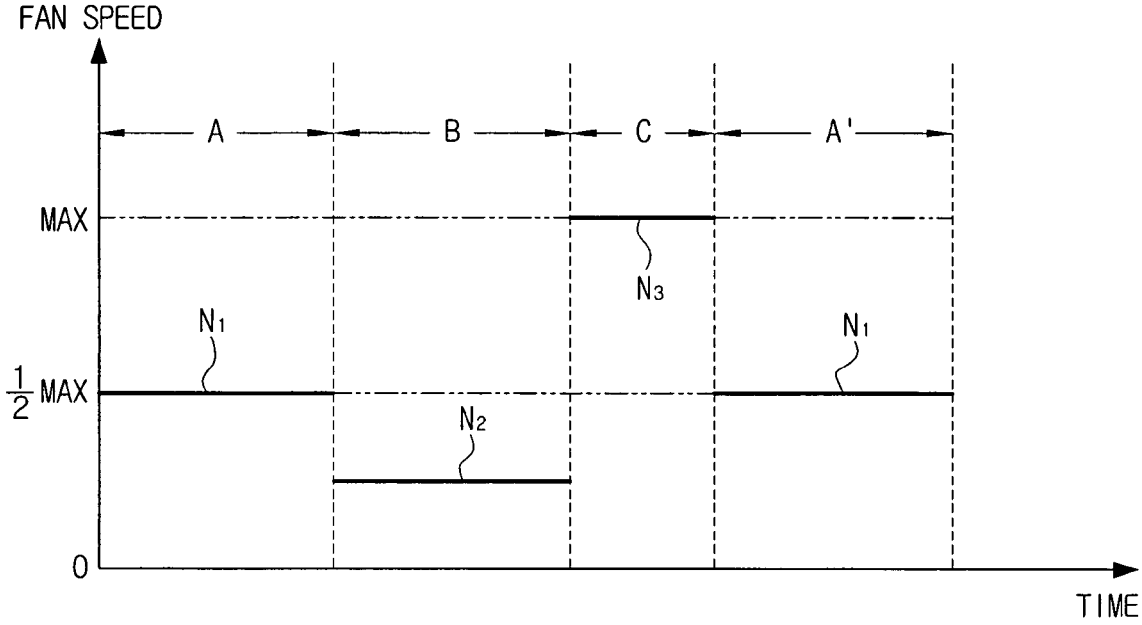

FIGS. 5A to 5C are views for explaining the operations of a wet-type electrophotographic image forming apparatus employing a method of controlling the oxidation catalyst device according to an embodiment of the present invention; and FIG. 6 is a graph showing examples of fan speeds for each step of driving the fan as controlled by an oxidation catalyst control device according to an embodiment of the present invention.

Throughout the drawings it should be understood that like reference numbers refer to like features and structures.

DETAILED DESCRIPTION OF THE PREFERRED EMBODIMENTS

A wet-type electrophotographic image forming apparatus employing a method of controlling an oxidation catalyst device according to embodiments of the present invention will now be described in detail with reference to the accompanying drawings.

Figure 1:
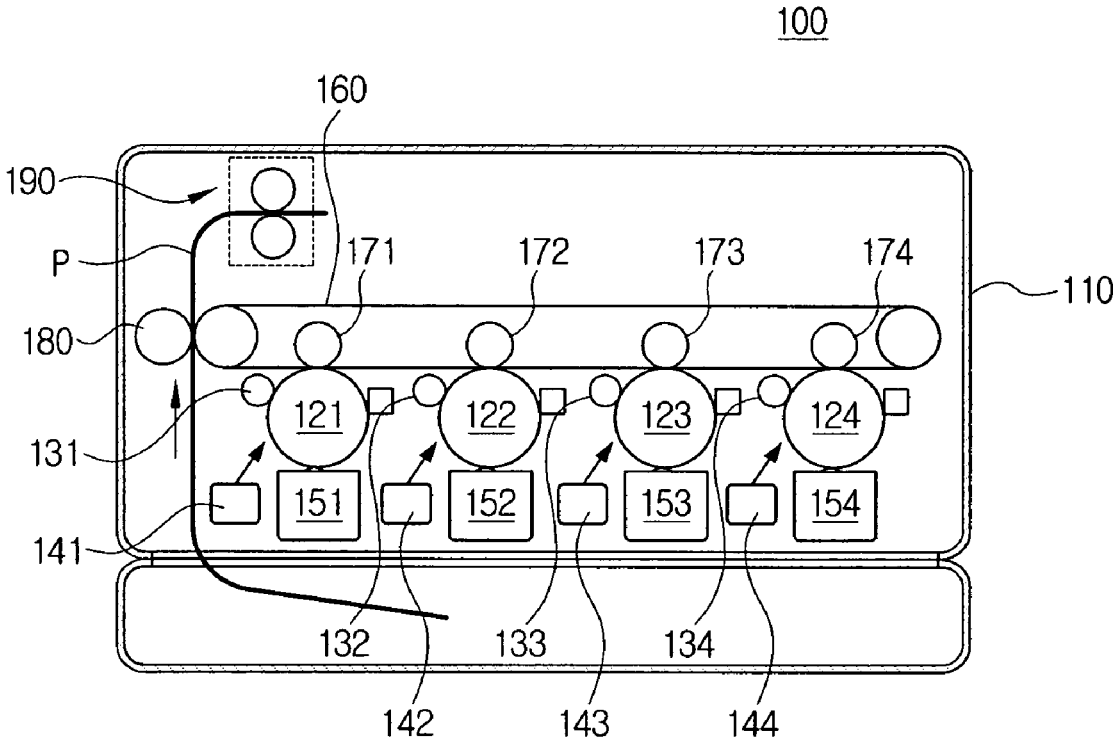
FIG. 1 (PRIOR ART)
FIG. 1 is a view illustrating the construction of a conventional wet-type electrophotographic image forming apparatus.
Figure 2:
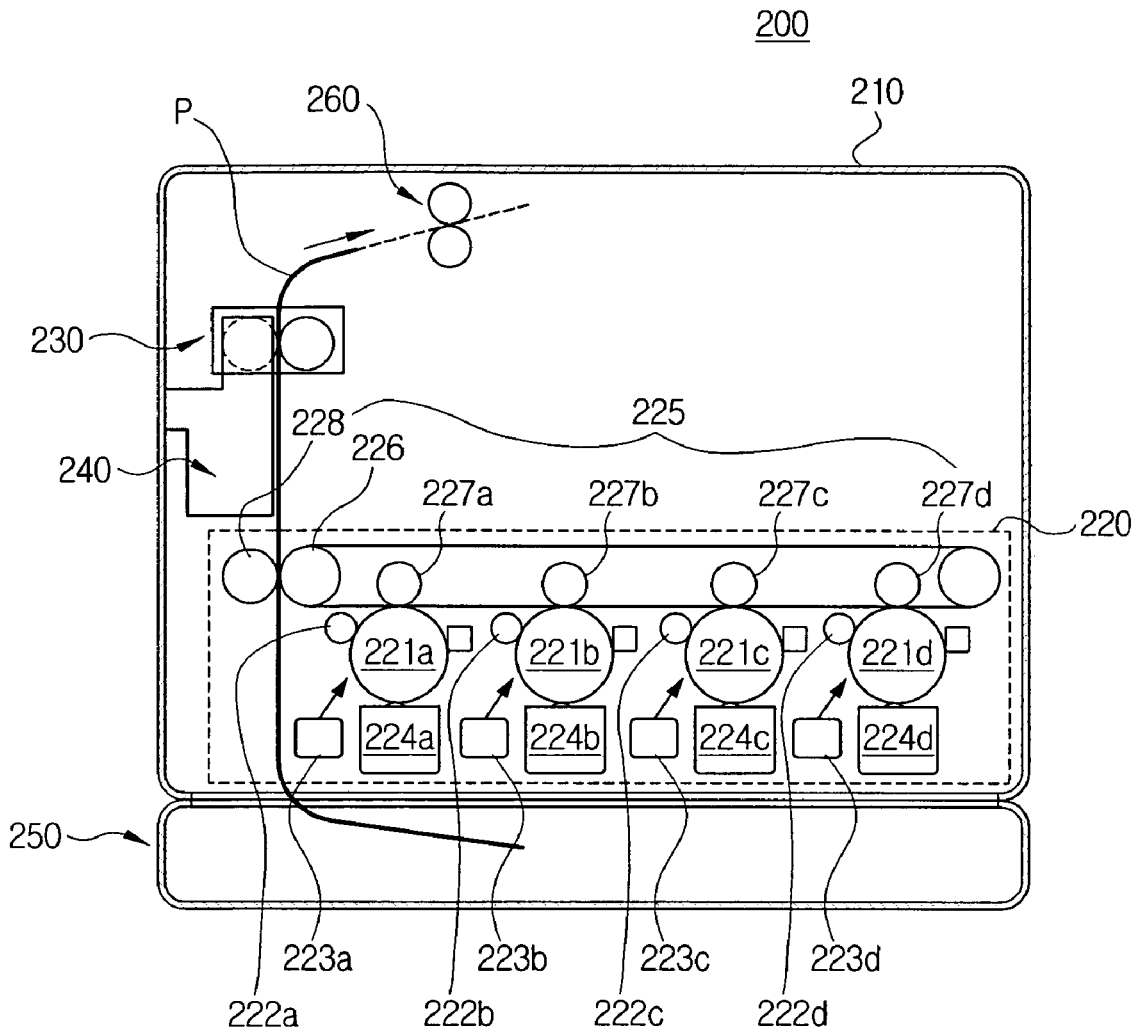
FIGS. 2 and 3 are views illustrating the construction of a wet-type electrophotographic image forming apparatus employing the method of controlling the oxidation catalyst device according to an embodiment of the present invention.
Figure 3:
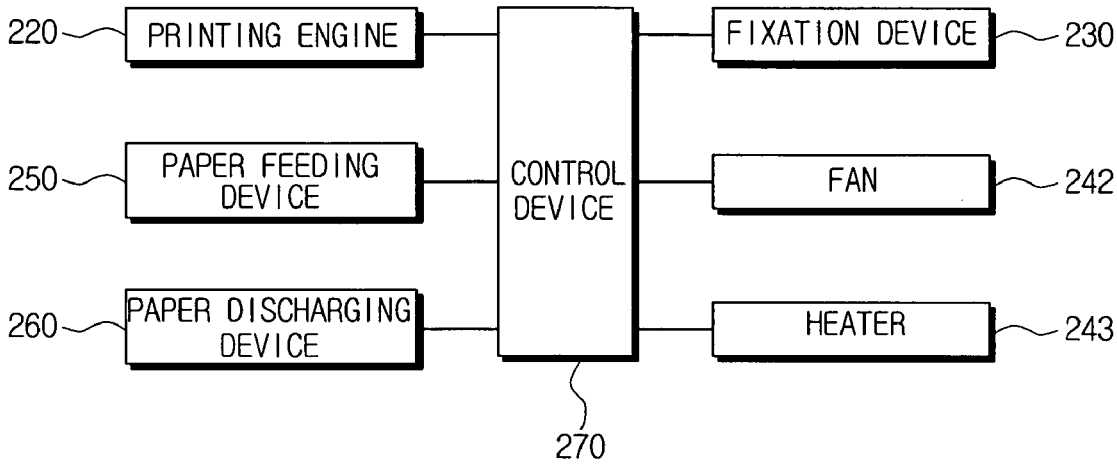

As shown in FIGS. 2 and 3, the wet-type electrophotographic image forming apparatus 200 according to an embodiment of the present invention comprises an image forming apparatus body 210 forming the outside of the image forming apparatus, a printing engine 220 for forming a visible image using a developer and transferring the visible image onto a paper P as it is fed through the apparatus, a fixation device 230 for fixing the transferred image onto the paper P, an oxidation catalyst device 240 connected to the fixation device 230, and a paper feeding device 250 for feeding the paper P into the printing engine 220. In addition, a control device 270 for controlling the entire operation of the image forming apparatus 200 is shown in FIG. 3.

The printing engine 220 of FIG. 2 comprises a plurality of photosensitive drums 221*a*, 221*b*, 221*c*, and 221*d* serving as photosensitive media for forming electrostatic latent images; a plurality of charging devices 222*a*, 222*b*, 222*c*, and 222*d* for charging the respective photosensitive drums 221*a*, 221*b*, 221*c*, and 221*d*; a plurality of exposure devices 223*a*, 223*b*, 223*c*, and 223*d* for scanning a laser beam to respective electrified photosensitive drums 221*a*, 221*b*, 221*c*, and 221*d*; a plurality of developing devices 224*a*, 224*b*, 224*c*, and 224*d* for supplying developer to the respective photosensitive drums 221*a*, 221*b*, 221*c*, and 221*d* each formed with an electrostatic image, thereby forming a visible image; and a transfer device 225 for transferring individual visible images formed on the respective photosensitive drums 221*a*, 221*b*, 221*c*, and 221*d*. The transfer device 225 comprises a transfer belt 226 forming an endless track and running in contact with the plurality of photosensitive drums 221*a*, 221*b*, 221*c*, and 221*d*; a plurality of first transfer rollers 227*a*, 227*b*, 227*c*, 227*d* for transferring the visible images formed on the respective photosensitive drums 221*a*, 221*b*, 221*c*, and 221*d* onto the transfer belt 226; and a second transfer roller 228 for transferring a resultant image formed by the visible images overlapped on the transfer belt 226 to a paper P.

The plurality of developing devices 224*a*, 224*b*, 224*c*, and 224*d* store color developers of different colors such as yellow, magenta, cyan and black, respectively, for forming a color image. These differently colored developers are preferably made of a toner-dispersed ink and a liquid carrier, such as a Norpar, and form a visible image when applied to an electrostatic latent image.

Figure 4:
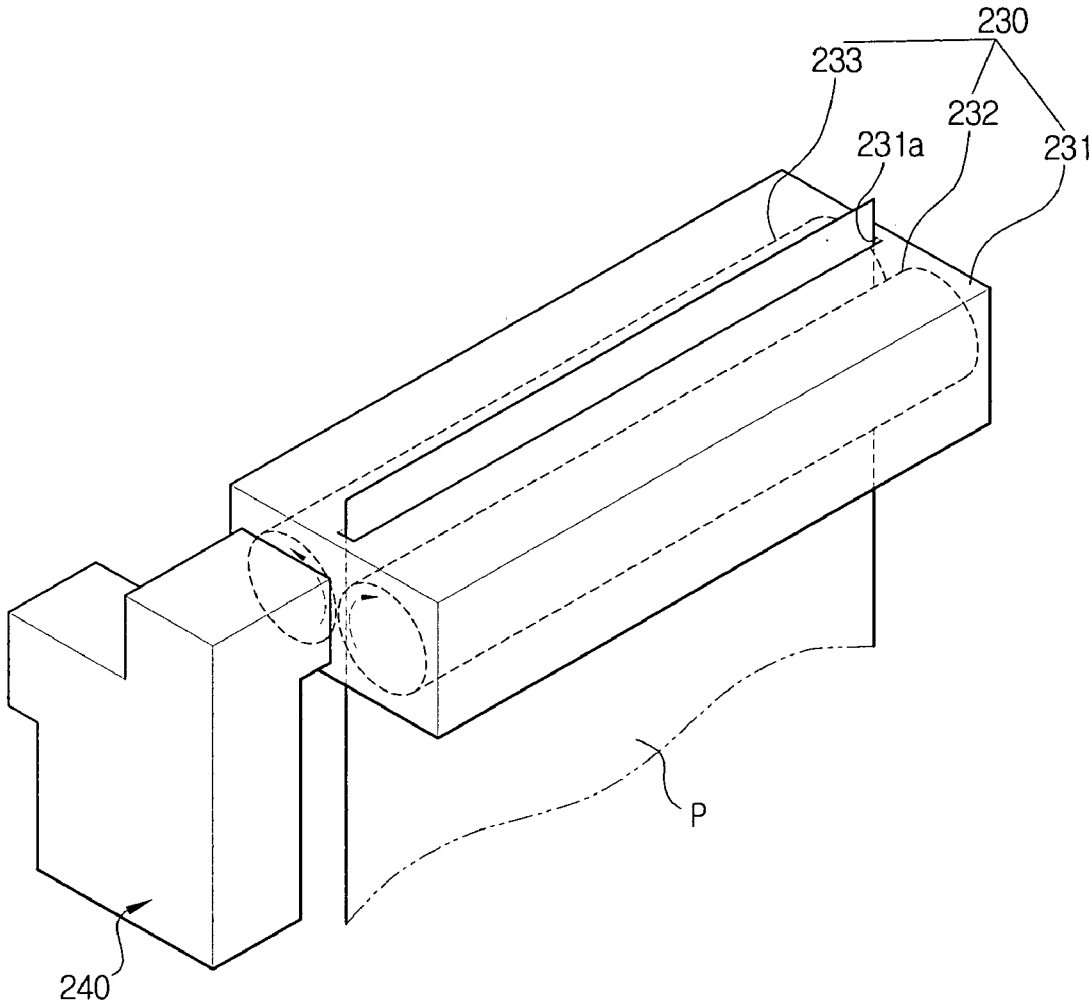
FIG. 4 is a perspective view illustrating the construction of a principal part of a wet-type electrophotographic image forming apparatus employing a method for controlling the oxidation catalyst device according to an embodiment of the present invention.

As shown in FIG. 4, the fixation device 230 comprises a casing 231 provided with a paper passage slot 231*a*, a heating roller 232 installed in the casing 231 to generate a high temperature, and a compression roller 233 installed in the casing 231 to rotate in contact with the heating roller 232.

The oxidation catalyst 240 facilitates oxidation resolution reaction of the carrier vapors generated as the developers deposited on the paper P are vaporized. As shown in FIG. 5A, the oxidation catalyst device 240 comprises a duct 241 connected to the casing 231 of the fixation device 230, a fan 242 installed within the duct 241 for forcibly discharging the air in the casing 231, a plurality of heaters 243 installed within the duct 241 for heating the forcibly discharged air, and a plurality of oxidation catalyst carrying bodies 244 installed adjacent to the heaters 243 in order to facilitate oxidation resolution reaction of the carrier vapors entrained in the discharged air. Each heater 243 comprises a pair of electrode plates 243*a* and 243*b*, and an electric heat plate 243*c* interposed between the electrode plates 243*a* and 243*b*. When electricity is applied to the heater 243, its temperature increases to about 220° C. to 230° C. Each oxidation catalyst carrying body 244 is deposited with an oxidation catalytic material such as platinum (Pt) or palladium (Pd), which is activated at 200° C. and facilitates an oxidation resolution reaction, which resolves the carrier vapors of combustible hydrocarbon gas into water and carbon dioxide. The number of heaters 243 and oxidation catalyst carrying bodies 244 installed within the duct 241 can be changed beyond that shown in the drawings.

The control device 270 (see FIG. 3) controls the respective components of the image forming apparatus 200. In particular, the control device 270 adjusts the rotational speed of the fan 242 by dividing the driving step of the fan 242 into several steps in order to increase the efficiency of the oxidation catalyst carrying bodies 244. When a direct current (DC) fan is employed, the adjustment of the rotational speed of the fan may be performed through a Pulse Width Modulation (PWM) control that changes duty-ratio of a pulse signal of voltage applied to the fan. Pulse Width Modulation control is well known in the art and need not be desribed in further detail herein.

Hereinbelow, the operations of the wet-type electrophotographic image forming apparatus and the method for controlling the oxidation catalyst device according to an embodiment of the present invention will be described with reference to FIGS. 2 through 6.

When a printing operation is initiated, the plurality of exposure devices 223*a*, 223*b*, 223*c*, and 223*d* scan a laser beam onto the photosensitive drums 221*a*, 221*b*, 221*c*, and 221*d*, respectively, thereby forming electrostatic latent images, as shown in FIG. 2. Then, the developing devices 224*a*, 224*b*, 224*c*, and 224*d* supply developers of yellow, magenta, cyan and black, for example, to the photosensitive drums 221*a*, 221*b*, 221*c*, and 221*d*, respectively, thereby forming visible images. The visible images formed in this manner are sequentially transferred onto the transfer belt 226, and a resultant image is formed on the transfer belt 226 as the visible images are overlapped on the transfer belt 226. Then, the resultant image is transferred onto a paper P fed between the transfer belt 226 and the second transfer roller 228, and the paper P is transmitted to the fixation device 230.

The control device 270 controls the operating speed of the fan 242 before the paper P arrives at the fixation device 230 as a first step (A in FIG. 6), by adjusting the rotational speed of the fan to $N_1$, as shown in FIG. 6. At this time, heat generated from the heaters 243 has been transferred to the oxidation catalyst carrying bodies 244 by the air flow generated in the duct, and the catalyst carrying bodies 244 have been smoothly warmed up by the heat of the heaters 243 to an activation temperature of about 200° C. In FIG. 6, although the rotational speed $N_1$ of the fan 242 is indicated as about 50% of the maximum rotational speed of the fan 242, the rotational speed $N_1$ may be varied depending on the maximum rotational speed of the fan 242 or the heating temperature of the heater 243.

Then, as shown in FIG. 5B, when the paper P passes the space between the heating roller 232 and the compression roller 233, the control device 270 controls the fan operation speed as a second step (B in FIG. 6), thereby adjusting the rotational speed to $N_2$. At this time, the rotational speed $N_2$ is slower than the rotational speed $N_1$ of the fan 242 in the first step (A), and the air within the fixation device 230 flows more slowly than at the first step (A). Therefore, carrier vapors are generated when the developers deposited on the paper P are vaporized. The carrier vapors slowly pass the plurality of heaters 243 and the plurality of oxidation catalyst carrying bodies 244 along with the air. The carrier vapors are completely oxidized and resolved and then discharged to the outside of the image forming apparatus body 210 (see FIG. 2). The second step (B) begins when the paper P arrives at a position between the heating roller 232 and the compression roller 233, at which position the generation of carrier vapors initiates. The second step (B) ends when the paper P completely escapes from the heating roller 232 and the compression roller 233 and the air entraining the carrier vapors completely escapes from the plurality of oxidation catalyst carrying bodies 244 within the duct 241. When a plurality of papers are successively printed, the second step (B) lasts from when the first paper arrives at a position between the heating roller 232 and the compression roller 233, the position where generation of carrier vapors initiates, until the carrier vapors generated from the last paper P completely escape from the plurality of oxidation catalyst carrying bodies 244.

In addition, as shown in FIG. 5C, after the paper P completely passes the fixation device 230, and the carrier vapors generated within the fixation device 230 completely escape from the plurality of oxidation catalyst carrying body 244, the control device 270 controls the operational speed of the fan 242 as the third step (C in FIG. 6), thereby adjusting the rotational speed of the fan to $N_3$. If the heating roller 232 is overheated, cooling the heating roller 232 is required because deformation may be caused to the surfaces of the heating roller 232 and the compression roller 233, which is in contact with the heating roller 232. For this purpose, the fan 242 rotates at a maximum speed in the third step (C) and rapidly discharges the heated air from the fixation device 230, thereby cooling the heating roller 232. The third step (C) typically takes a shorter time than steps A and B of the fan 232.

The paper P passed through the fixation device 230 is discharged through a paper discharging device 260 (FIG. 2) to the outside of the image forming apparatus 210 (FIG. 2).

After the heating roller 232 is cooled, the control device 270 changes the speed of the fan 242 to be the speed $N_1$ of first step (A) again.

As described above, while the fan 242 incrementally rotates over the first step (A), the second step (B) and the third step (C), electric power is continuously applied to the heater 243 to maintain a constant temperature so the oxidation catalyst carrying bodies 244 are not cooled.

Although a wet-type electrophotographic image forming apparatus provided with a transfer belt for relaying visible images and a plurality of photosensitive drums 221*a*, 221*b*, 221*c*, and 221*d* is shown and described above in order to illustrate the present invention, the present invention is not limited thereto. The present invention can be employed in various types of image forming apparatuses using a developer, including wet-type electrophotographic image forming apparatuses forming electrostatic latent images on a photosensitive belt instead of the photosensitive drums among others.

According to an embodiment of the present invention as described above, as the rotational speed of the fan 242 is adjusted over three divided steps, it is possible to increase the efficiency of the oxidation catalyst device 240 for facilitating the oxidation resolution reaction of carrier vapors generated in the fixation device 230.

In addition, according to an embodiment of the present invention, because the heating roller 233 can be cooled quickly after finishing the fixation operation within a short length of time, and overheating of the heating roller 233 can be prevented.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A method for controlling an oxidation catalyst device for a wet-type electrophotographic image forming apparatus, in which the oxidation catalyst device comprises a duct for guiding air inside a fixation device, which applies heat and pressure to a paper deposited with a developer consisting of ink and liquid carrier, to the outside of the fixation device, a fan for forcibly discharging the air inside the fixation device, a heater for heating the air discharged from the fixation device, and an oxidation catalyst device-carrying body for facilitating oxidation resolution reaction of the carrier vapors entrained in the air as being discharged, the method comprising the steps of:

(A) driving the fan at a rotational speed of $N_1$, during which the oxidation catalyst carrying body is warmed up; and (B) driving the fan at a rotational speed of $N_2$, during which the carrier vapors are heated and resolved;

wherein the rotational speed $N_1$ of the fan in step (A) is larger than the rotational speed $N_2$ of the fan in step (B).

2. The method according to claim 1, wherein, after step (B), the fan driving step further comprises:

(C) driving the fan at a rotational speed of $N_3$, during which the fixation device is cooled.

3. The method according to claim 1, wherein the fan is controlled by a Pulse Width Modulation (PWM) control method, that adjusts a duty-ratio of a pulse signal applied to the fan.

4. The method according to claim 1, wherein the heater is operated at a constant temperature while the fan is rotating.

5. A method for controlling an oxidation catalyst device for a wet-type electrophotographic image forming apparatus, in which the oxidation catalyst device comprises a duct for guiding air inside a fixation device, which applies heat and pressure to a paper deposited with a developer consisting of ink and liquid carrier, to the outside of the fixation device, a fan for forcibly discharging the air inside the fixation device, a heater for heating the air discharged from the fixation device, and an oxidation catalyst device-carrying body for facilitating oxidation resolution reaction of the carrier vapors entrained in the air as being discharged, the method comprising the steps of:

(A) driving the fan at a rotational speed of $N_1$, during which the oxidation catalyst carrying body is warmed up; and (B) driving the fan at a rotational speed of $N_2$, during which the carrier vapors are heated and resolved;

wherein, after step (B), the fan driving step further comprises (C) driving the fan at a rotational speed of $N_3$, during which the fixation device is cooled; and wherein the rotational speed $N_3$ of the fan in step (C) is larger than the rotational speed $N_2$ of the fan in step (B).

6. A method for controlling an oxidation catalyst device for a wet-type electrophotographic image forming apparatus, in which the oxidation catalyst device comprises a duct for guiding air inside a fixation device, which applies heat and pressure to a paper deposited with a developer consisting of ink and liquid carrier, to the outside of the fixation device, a fan for forcibly discharging the air inside the fixation device, a heater for heating the air discharged from the fixation device, and an oxidation catalyst device-carrying body for facilitating oxidation resolution reaction of the carrier vapors entrained in the air as being discharged, the method comprising the steps of:

(A) driving the fan at a rotational speed of $N_1$, during which the oxidation catalyst carrying body is warmed up; and (B) driving the fan at a rotational speed of $N_2$, during which the carrier vapors are heated and resolved;

wherein, after step (B), the fan driving step further comprises (C) driving the fan at a rotational speed of $N_3$, during which the fixation device is cooled;

and wherein the rotational speeds, $N_1$, $N_2$ and $N_3$ in steps (A)–(C) have a relation of $N_3>N_1>N_2$.

7. A method for controlling an oxidation catalyst device for a wet-type electrophotographic image forming apparatus, in which the oxidation catalyst device comprises a duct for guiding air inside a fixation device, which applies heat and pressure to a paper deposited with a developer consisting of ink and liquid carrier, to the outside of the fixation device, a fan for forcibly discharging the air inside the fixation device, a heater for heating the air discharged from the fixation device, and an oxidation catalyst device-carrying body for facilitating oxidation resolution reaction of the carrier vapors entrained in the air as being discharged, the method comprising the steps of:

(A) driving the fan at a rotational speed of $N_1$, during which the oxidation catalyst carrying body is warmed up; and (B) driving the fan at a rotational speed of $N_2$, during which the carrier vapors are heated and resolved;

wherein, after step (B), the fan driving step further comprises (C) driving the fan at a rotational speed of $N_3$, during which the fixation device is cooled; and wherein the rotational speed $N_3$ of the fan in step (C) is the maximum rotational speed of the fan.

8. A control apparatus for controlling an oxidation catalyst device of a wet-type electrophotographic image forming apparatus, said control apparatus comprising:

a duct for guiding air inside a fixation device to the outside of the fixation device;

a fan for forcibly discharging the air inside the fixation device through the duct;

a heater for heating the air discharged from the fixation device;

at least one oxidation catalyst device-carrying body; and a control device;

wherein the control device drives the fan at a rotational speed of $N_1$, during which the oxidation catalyst carrying body is warmed up; and drives the fan at a rotational speed of $N_2$, during which the carrier vapors are heated and resolved; and wherein the rotational speed $N_1$ of the fan is larger than the rotational speed $N_2$ of the fan.

9. The control apparatus according to claim 8, wherein the control device further drives the fan at a rotational speed of $N_3$, during which the fixation device is cooled.

10. The control apparatus according to claim 8, wherein the control device uses Pulse Width Modulation (PWM) control that adjusts the duty-ratio of a pulse signal applied to the fan.

11. The control apparatus according to claim 8, wherein the heater is operated at a constant temperature while the fan is rotating.

12. The control apparatus according to claim 8, wherein the at least one oxidation catalyst device-carrying body is installed in the duct.

13. A control apparatus for controlling an oxidation catalyst device of a wet-type electrophotographic image forming apparatus, said control apparatus comprising:

a duct for guiding air inside a fixation device to the outside of the fixation device;

a fan for forcibly discharging the air inside the fixation device through the duct;

a heater for heating the air discharged from the fixation device;

at least one oxidation catalyst device-carrying body; and a control device;

wherein the control device drives the fan at a rotational speed of $N_1$, during which the oxidation catalyst carrying body is warmed up; and drives the fan at a rotational speed of $N_2$, during which the carrier vapors are heated and resolved; and wherein the control device further drives the fan at a rotational speed of $N_3$, during which the fixation device is cooled; and wherein the rotational speed $N_3$ of the fan is larger than the rotational speed $N_2$ of the fan.

14. A control apparatus for controlling an oxidation catalyst device of a wet-type electrophotographic image forming apparatus, said control apparatus comprising:

a duct for guiding air inside a fixation device to the outside of the fixation device;

a fan for forcibly discharging the air inside the fixation device through the duct;

a heater for heating the air discharged from the fixation device;

at least one oxidation catalyst device-carrying body; and a control device;

wherein the control device drives the fan at a rotational speed of $N_1$, during which the oxidation catalyst carrying body is warmed up; and drives the fan at a rotational speed of $N_2$, during which the carrier vapors are heated and resolved; and wherein the control device further drives the fan at a rotational speed of $N_3$, during which the fixation device is cooled; and wherein the rotational speeds, $N_1$, $N_2$ and $N_3$ have a relation of $N_3>N_1>N_2$.

15. A control apparatus for controlling an oxidation catalyst device of a wet-type electrophotographic image forming apparatus, said control apparatus comprising:

a duct for guiding air inside a fixation device to the outside of the fixation device;

a fan for forcibly discharging the air inside the fixation device through the duct;

a heater for heating the air discharged from the fixation device;

at least one oxidation catalyst device-carrying body; and a control device;

wherein the control device drives the fan at a rotational speed of $N_1$, during which the oxidation catalyst carrying body is warmed up; and drives the fan at a rotational speed of $N_2$, during which the carrier vapors are heated and resolved; and wherein the control device further drives the fan at a rotational speed of $N_3$, during which the fixation device is cooled; and wherein the rotational speed $N_3$ of the fan is the maximum rotational speed of the fan.

16. A method for controlling an oxidation catalyst device for a wet-type electrophotographic image forming apparatus, in which the oxidation catalyst device comprises a duct for guiding air inside a fixation device, which applies heat and pressure to a paper deposited with a developer consisting of ink and liquid carrier, to the outside of the fixation device, a fan for forcibly discharging the air inside the fixation device, a heater for heating the air discharged from the fixation device, and an oxidation catalyst device-carrying body for facilitating oxidation resolution reaction of the carrier vapors entrained in the air as being discharged, the method comprising the steps of:

(A) driving the fan at a rotational speed of $N_1$, during which the oxidation catalyst carrying body is warmed up; and (B) driving the fan at a rotational speed of $N_2$, during which the carrier vapors are heated and resolved, wherein, after step (B), the fan driving step further comprises:

(C) driving the fan at a rotational speed of $N_3$, during which the fixation device is cooled, and the rotational speed $N_3$ is larger than the rotational speed $N_2$.

17. A method for controlling an oxidation catalyst device for a wet-type electrophotographic image forming apparatus, in which the oxidation catalyst device comprises a duct for guiding air inside a fixation device, which applies heat and pressure to a paper deposited with a developer consisting of ink and liquid carrier, to the outside of the fixation device, a fan for forcibly discharging the air inside the fixation device, a heater for heating the air discharged from the fixation device, and an oxidation catalyst device-carrying body for facilitating oxidation resolution reaction of the carrier vapors entrained in the air as being discharged, the method comprising the steps of:

(A) driving the fan at a rotational speed of $N_1$, during which the oxidation catalyst carrying body is warmed up; and (B) driving the fan at a rotational speed of $N_2$, during which the carrier vapors are heated and resolved, wherein, after step (B), the fan driving step further comprises:

(C) driving the fan at a rotational speed of $N_3$, during which the fixation device is cooled, and wherein the rotational speed $N_3$ is the maximum rotational speed of the fan.

18. A control apparatus for controlling an oxidation catalyst device of a wet-type electrophotographic image forming apparatus, said control apparatus comprising:

a duct for guiding air inside a fixation device to the outside of the fixation device;

a fan for forcibly discharging the air inside the fixation device through the duct;

a heater for heating the air discharged from the fixation device;

at least one oxidation catalyst device-carrying body; and a control device, wherein the control device drives the fan at a rotational speed of $N_1$, during which the oxidation catalyst carrying body is warmed up, and drives the fan at a rotational speed of $N_2$, during which the carrier vapors are heated and resolved, and further wherein the control device drives the fan at a rotational speed of $N_3$, during which the fixation device is cooled, wherein the rotational speed $N_3$ of the fan is larger than the rotational speed $N_2$ of the fan.

19. A control apparatus for controlling an oxidation catalyst device of a wet-type electrophotographic image forming apparatus, said control apparatus comprising:

a duct for guiding air inside a fixation device to the outside of the fixation device;

a fan for forcibly discharging the air inside the fixation device through the duct;

a heater for heating the air discharged from the fixation device;

at least one oxidation catalyst device-carrying body; and a control device, wherein the control device drives the fan at a rotational speed of $N_1$, during which the oxidation catalyst carrying body is warmed up, and drives the fan at a rotational speed of $N_2$, during which the carrier vapors are heated and resolved, and further wherein the control device further the fan at a rotational speed of $N_3$, during which the fixation device is cooled, wherein the rotational speed $N_3$ of the fan is the maximum rotational speed of the fan.

* * * * *